US006742533B2

(12) United States Patent
Olson

(10) Patent No.: US 6,742,533 B2
(45) Date of Patent: Jun. 1, 2004

(54) TEMPORARY OUTDOOR SHELTER

(76) Inventor: Charles J. Olson, 478 Amhurst Rd., Valparaiso, IN (US) 46383

( * ) Notice: Subject to any disclaimer, the term of this patent is extended or adjusted under 35 U.S.C. 154(b) by 44 days.

(21) Appl. No.: 10/064,017

(22) Filed: Jun. 4, 2002

(65) Prior Publication Data

US 2003/0221716 A1 Dec. 4, 2003

(51) Int. Cl.[7] ..... E04H 15/30

(52) U.S. Cl. ..... 135/95; 135/199; 428/99; 52/63; 52/64

(58) Field of Search ..... 135/95, 115, 119; 52/3, 4, 23, 63, 64, DIG. 10; 2/89; 428/99

(56) References Cited

U.S. PATENT DOCUMENTS

| | | | | | |
|---|---|---|---|---|---|
| 1,155,800 | A | * | 10/1915 | Corbet | |
| 1,215,139 | A | * | 2/1917 | Gail | |
| 1,239,550 | A | | 9/1917 | Wykert | 135/87 |
| 1,658,214 | A | | 2/1928 | Thomas | 135/87 |
| 1,672,338 | A | | 6/1928 | Lilleso-Petersen | 135/95 |
| 1,871,101 | A | * | 8/1932 | Waltz | |
| 2,093,889 | A | * | 9/1937 | Horn | |
| 2,263,867 | A | | 11/1941 | Barnard | 135/90 |
| 2,567,697 | A | | 9/1951 | Craighead, Jr. et al. | 135/90 |
| 4,064,662 | A | * | 12/1977 | O'Toole | |
| 4,198,997 | A | | 4/1980 | Miller | 135/1 R |
| 4,719,934 | A | | 1/1988 | Mydans | 135/90 |
| 5,662,134 | A | | 9/1997 | Auer | 135/156 |
| 5,667,855 | A | * | 9/1997 | Borden et al. | |
| 5,769,106 | A | * | 6/1998 | Achuff | |
| 6,003,749 | A | * | 12/1999 | Sabo | |
| 6,341,379 | B1 | * | 1/2002 | Kokus | |

* cited by examiner

*Primary Examiner*—Robert Canfield
(74) *Attorney, Agent, or Firm*—Gary M. Hartman; Domenica N. S. Hartman; Hartman & Hartman

(57) ABSTRACT

An outdoor shelter comprising a sheet member (10) having a generally rectangular-shaped portion and a slit (26) extending from a first corner (62) of the sheet member (10) to the central region (50) of the sheet member (10). The slit (26) defines separated opposing edges, which are equipped with complementary means (30,32) for selectively securing the edges together. The edges define a first fold line (41) when secured together by the securing means (30,32). A third securing means (38) is disposed on a second fold line (42) extending from the central region (50) to a second corner (68) of the sheet member (10) adjacent the first corner (62). The third securing means (38) is complementary to the securing means (32) to enable the second fold line (42) to be secured to one of the edges of the slit (26). By selectively securing the securing means (30,32) to each other or the third securing means (38), the sheet member (10) can be configured to achieve a variety of shelter configurations.

20 Claims, 2 Drawing Sheets

TEMPORARY OUTDOOR SHELTER

BACKGROUND OF INVENTION

1. Field of the Invention

The present invention generally relates to temporary outdoor shelters and their construction. More particularly, this invention relates to sheet member that can be configured to serve as a tarp, open-ended shelter, closed or reflector-type tent, or another type of outdoor shelter.

2. Description of the Related Art

Various types of tents and other outdoor shelters have been proposed. Most are limited to a single configuration, such as a closed tent with one or more panels or flaps that serve as a closure. For mountaineering and other forms of more challenging outdoor activities, versatility with minimal weight are important features. As a result, outdoor shelters have been proposed that are relatively lightweight and simple in their construction. An example is U.S. Pat. No. 2,567,697 to Craighead, Jr., et al., which discloses a tarp equipped with zippers and configured to be raised to form a rainfly, tent or lean-to shelter. The tarp requires a number of poles in order to form an open-ended tent, and cannot be configured to be completely closed and have an awning to keep a backpack, etc., dry while stored outside of the shelter. Reconfiguring the shelter from a rainfly to a tent requires the shelter to be taken down, which may be extremely difficult if not impossible under certain conditions.

In view of the above, it would be desirable if more versatile, lightweight shelter was available that can be readily set up to have one of a number of different configurations.

SUMMARY OF INVENTION

The present invention provides an outdoor shelter comprising a sheet member having an uncomplicated construction, yet is versatile in being configurable to erect different types of shelters, such as a closed tent, an open-ended shelter, or a reflector tent.

The sheet member has a generally rectangular-shaped portion, i.e., having four corners and four peripheral edges. With this construction, the sheet member has four fold lines that extend from the corners to a central region of the sheet member. The fold lines delineate four triangular-shaped panel regions of the sheet member. The sheet member further comprises a slit extending from a first of the four corners to the central region of the sheet member. The slit defines separated opposing edges between the first corner and the central region of the sheet member. First and second complementary securing means are disposed at the opposing edges for selectively and temporarily securing the opposing edges together. The opposing edges define a first of the fold lines when secured together by the first and second complementary securing means. A third securing means is disposed on a second of the fold lines extending from the central region of the sheet member to a second corner of the sheet member adjacent the first corner. The third securing means is complementary to at least one of the first and second complementary securing means to enable the second fold line to be secured to one of the opposing edges. By selectively securing the first and second complementary securing means to each other or the third securing means, the sheet member can be configured to achieve a variety of shelter configurations.

In a preferred aspect of the invention, the sheet member further comprises a second slit that extends along a third of the fold lines from the central region of the sheet member toward but not to a third of the four corners. The second slit defines a second pair of opposing edges between the central region and the third corner, and is equipped with fourth and fifth complementary securing means for selectively and temporarily securing the second pair of opposing edges together. The second slit can be used to provide a ventilation opening for the shelter.

A significant advantage of this invention is that the sheet member makes possible a variety of lightweight and portable shelter configurations. A preferred feature of the invention is the ability to raise the shelter with a single cord while the corners and/or edges of the sheet member are appropriately anchored. Accordingly, a desired shelter configuration can be quickly and readily set up with minimal tools. Another preferred feature of the invention is that the sheet member can be reconfigured without necessitating that the shelter be torn down, so that the user can easily adapt the shelter for changing weather conditions or needs.

Other objects and advantages of this invention will be better appreciated from the following detailed description.

DETAILED DESCRIPTION

Figure 1:
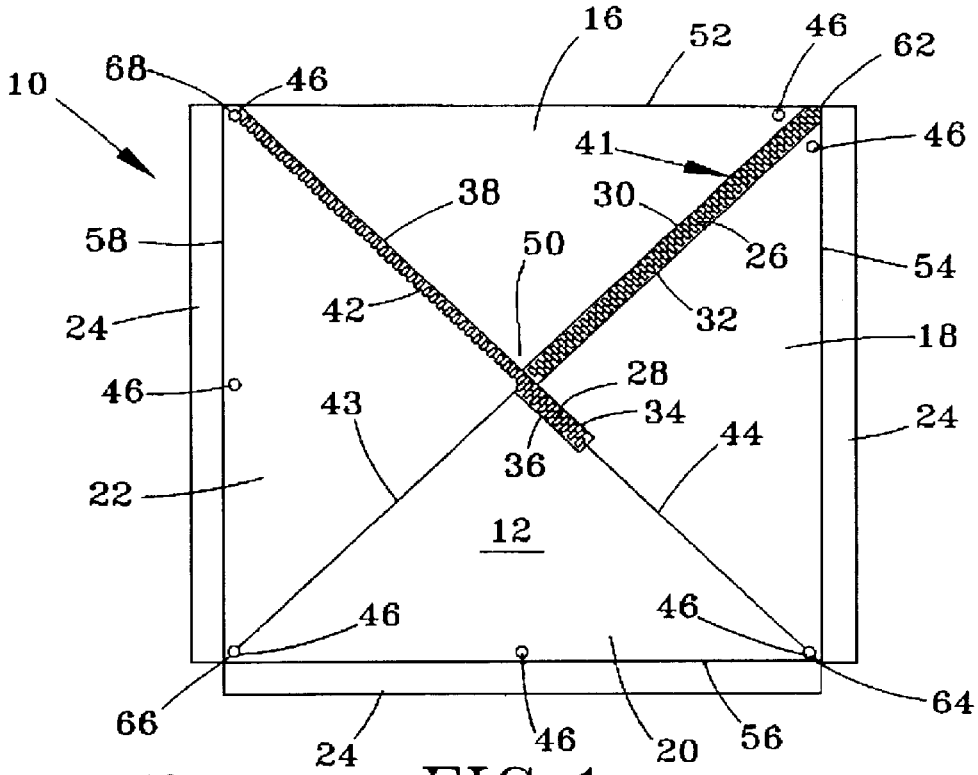
FIGS. 1 and 2 are views of the interior and exterior surfaces, respectively, of a tarp configured in accordance with a preferred embodiment of this invention.
Figure 2:
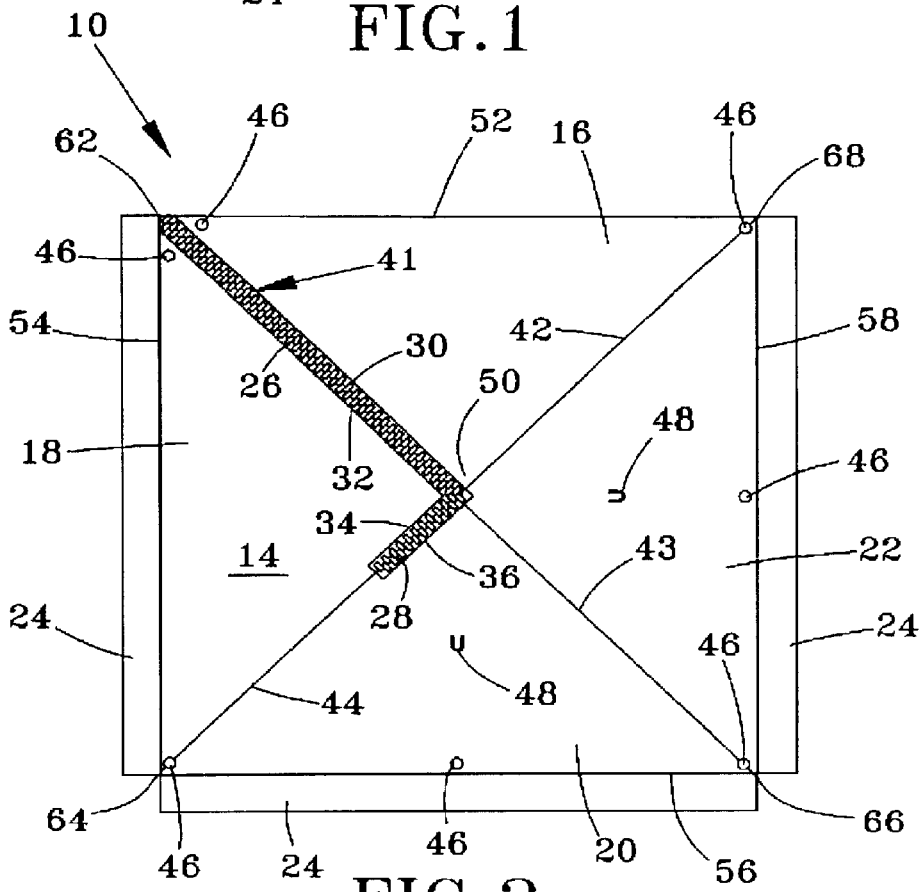

A sheet-like article, referred to herein as a tarp 10, is represented in FIGS. 1 and 2 as configured for erecting a variety of outdoor shelters. Opposite surfaces 12 and 14 of the tarp 10 are shown in FIGS. 1 and 2, and will be referred to as the interior and exterior surfaces of the tarp 10, respectively, though not intending to limit the potential use, orientation or placement of these surfaces 12 and 14. In FIGS. 1 and 2, the tarp 10 can be seen to have a generally rectangular shape, more particularly a square shape, with four peripheral edges 52, 54, 56 and 58 intersecting to define four corners 62, 64, 66 and 68 of the tarp 10. Grommets 46 are represented as being provided at the corners 62, 64, 66 and 68 and two of the edges 56 and 58 for staking down the tarp 10 when configured as a shelter, though from FIGS. 1 and 2 it can be seen that the tarp 10 may also be used as a ground cover. Loops 48 for attaching guy-lines or another suitable anchor are provided on the exterior surface 14 of the tarp 10. Loops similar to the loops 48 (or other suitable features) could be substituted for the grommets 46. Suitable dimensions for the area delimited by the edges 52, 54, 56 and 58 are about three by about three meters, though other sizes are within the scope of the invention. The tarp 10 can be constructed of a variety of materials, including canvas and polymeric sheet materials as known in the art.

Three of the edges 54, 56 and 58 are shown in FIGS. 1 and 2 as not defining the outer perimeter of the tarp 10, which instead is defined by the edge 52 and three sod cloths 24 that extend from the edges 54, 56 and 58. As will become apparent from the following discussion, the sod cloths 24 enable the lower edges of shelters constructed with the tarp 10 to be sealed at ground level to better protect the occupants of the shelter, as known in the art. It is within the scope of the invention that the sod cloths 24 could be eliminated, such that the edges 52, 54, 56 and 58 would then define the outer perimeter of the tarp 10.

The tarp 10 can be generally seen to have four diagonal lines 41, 42, 43 and 44 of division that extend from the four corners 62, 64, 66 and 68 of the tarp 10 to a central region or point 50 of the tarp 10. These lines 41, 42, 43 and 44 will be referred to as fold lines, indicating that the tarp 10 may be folded along these lines 41, 42, 43 and 44 when erecting a shelter. The fold lines 41, 42, 43 and 44 delineate four triangular-shaped panels 16, 18, 20 and 22 within the area delimited by the edges 52, 54, 56 and 58 of the tarp 10. In FIGS. 1 and 2, a slit 26 is present at the fold line 41, thereby separating the panels 16 and 18. The slit 26 is shown as being continuous and extending from the central point 50 through a first corner 62 of the tarp 10. The slit 26 defines opposing edges of the panels 16 and 18 that can be secured together using any suitable means, such as complementary zipper portions 30 and 32 represented in FIGS. 1 and 2.

A third zipper portion 38 can be seen in FIG. 1 on the interior surface 12 of the tarp 10 and extending along a second fold line 42 separating the panels 16 and 22. The zipper portion 38 is preferably attached to the interior surface 12, and therefore is not present on the exterior surface 14 of the tarp 10. The zipper portion 38 is preferably continuous from a second corner 64 to the central point 50 of the tarp 10, and preferably complementary to the zipper portion 32 so that the zipper portion 38 can be secured to the zipper portion 32 at the fold line 41 to alter the configuration of the shelter being constructed. While represented and discussed as being constructed as a zipper that is complementary to the zipper portion 32, the zipper portion 38 (as well as the zipper portions 30 and 32) could be of any suitable fastener construction, e.g., ties, snaps, a hook-and-loop fastener such as VELCRO, etc.

A second slit 28 in the tarp 10 is shown in FIGS. 1 and 2 as extending along a limited portion of the fold line 44, from the central point 50 toward but not to the corner 64 of the tarp 10. The second slit 28 preferably intersects the first slit 26, and defines opposing edges that can be secured together using any suitable means, such as complementary zipper portions 34 and 36 represented in FIGS. 1 and 2. A suitable length for the slit 28 is about twenty centimeters, though other lengths are within the scope of the invention.

Figure 3:
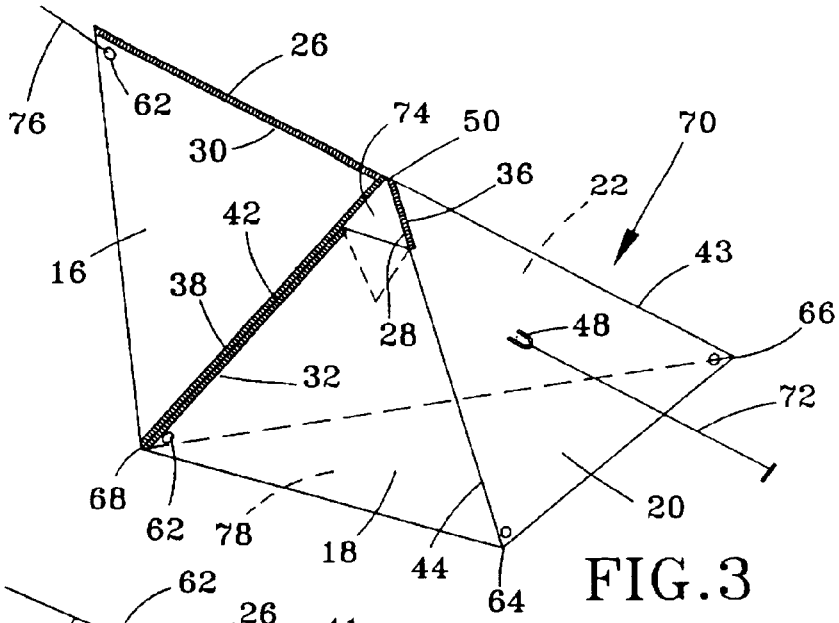
FIGS. 3, 4 and 5 represent perspective views of three types of shelters erected with the tarp of FIGS. 1 and 2.

With reference to FIG. 3, a closed tent 70 is represented as having been constructed with the tarp 10 shown in FIGS. 1 and 2. The tent 70 can be seen to have a triangular-shaped base 78 and three walls defined by the panels 18, 20 and 22 of the tarp 10. The sod cloths 24 are omitted for clarity in FIG. 3 (as well as FIGS. 4 and 5). Guy-lines 72 (only one of which is visible) are attached to the loops 48 for supporting the tent walls defined by the panels 20 and 22. The zipper portions 30 and 32 along the slit 26 are shown as being uncoupled, and instead the zipper portion 32 is shown as being secured to the third zipper portion 38 to close the tent 70. The remaining panel 16 of the tarp 10 (between the fold line 42 and the adjacent edge of the slit 26) is shown as being attached to a cord 76 or other suitable element by which the center point 50 of the tarp 10 can be raised and supported from a tree, pole or other structure. In this configuration, the panel 16 serves as a rainfly protecting the entrance to the tent 70 through the panel 18. The zipper portions 32 and 38 are shown as being unzipped at their upper ends near the center point 50 of the tarp 10, as are the zipper portions 34 and 36 at the second slit 28. In this manner, a ventilation opening 74 is provided for the tent 70. The tent 70 can be entered and exited by unzipping the zipper portions 32 and 38, preferably starting at the lower ends of the zipper portions 32 and 38.

Figure 4:
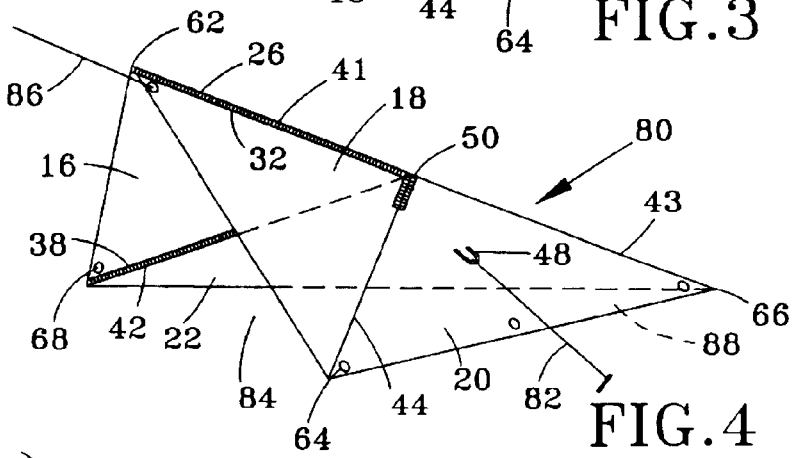

FIG. 4 represents an open-ended shelter 80 constructed from the tarp 10 of FIGS. 1 and 2. The shelter 80 has a triangular-shaped floor space 88, but only two walls. One of the walls is defined by the panels 18 and 20 of the tarp 10, while the second wall is defined by the panels 16 and 22. Guy-lines 82 (only one of which is visible) are again attached to the loops 48 for supporting the walls. To arrive at this configuration, the zipper portions 30 and 32 along the slit 26 are fastened together, and the corner 62 of the tarp 10 is attached to a cord 86 (or other suitable element) to allow the tarp 10 to be raised and supported from a tree, pole, etc. In this manner, the panels 16 and 18 form an awning over the entrance 84 to the shelter 80. Notably, the open-ended shelter 80 of FIG. 4 can be reconfigured as the closed tent 70 of FIG. 3 by unzipping the zipper portions 30 and 32, and then zipping the zipper portion 32 to the zipper portion 38.

Figure 5:
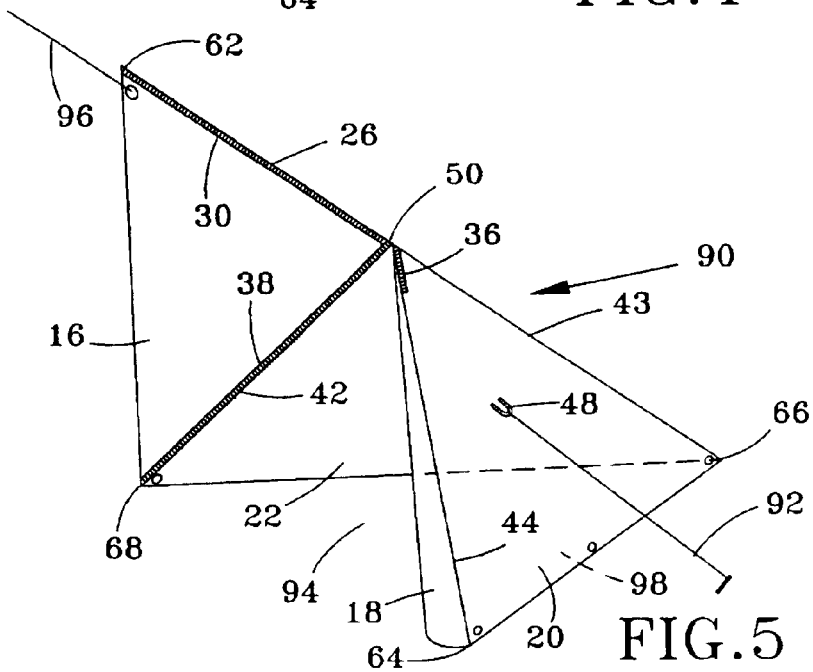

Finally, FIG. 5 represents a reflector tent 90 constructed from the tarp 10 of FIGS. 1 and 2. As with the previous shelters illustrated for this invention, the tent 90 has a triangular-shaped floor space 98. The tent 90 has two walls defined by the panels 20 and 22, each of which is supported by a guy-line 92 (one of which is visible in FIG. 5). To arrive at this configuration, the zipper portions 30, 32 and 38 are not fastened together, the panel 18 is rolled up and stowed within the interior of the tent 90, and the corner 62 of the tarp 10 is attached to a cord 96 that supports the tarp 10 from a tree, pole, etc. In this configuration, the panel 16 serves as a reflector for reflecting heat from a fire near the entrance 94 of the tent 90 into the interior of the tent 90. The tent 90 of FIG. 5 can be reconfigured as the closed tent 70 of FIG. 3 by zipping the zipper portion 32 along the edge of the panel 18 to the zipper portion 38 at the fold line 42. The tent 90 of FIG. 5 can also be reconfigured as the open-ended shelter 80 of FIG. 4 by zipping the zipper portion 32 along the edge of the panel 18 to the zipper portion 30, seen in FIG. 5 at the upper edge of the panel 16.

While the invention has been described in terms of certain embodiments, it is apparent that other forms could be adopted by one skilled in the art. Therefore, the scope of the invention is to be limited only by the following claims.

What is claimed is:

1. An outdoor shelter comprising a sheet member having a rectangular-shaped portion that defines oppositely-disposed first and second surfaces, four corners and four peripheral edges, the sheet member comprising:

a first slit extending from a first of the four corners to a central region of the sheet member, the first slit defining separated opposing edges between the first corner and the central region;

first and second complementary means disposed at the opposing edges defined by the first slit for selectively and temporarily securing the opposing edges together, the opposing edges defining a first fold line when secured together by the first and second complementary securing means;

a second fold line extending from a second corner of the four corners to the central region of the sheet member, the second corner being adjacent the first corner of the sheet member; and third securing means disposed along the second fold line so as to be present only on the first surface of the sheet member, the third securing means being complementary to the second complementary securing means to enable the second fold line to be temporarily secured to one of the opposing edges defined by the first slit.

2. An outdoor shelter according to claim 1, the sheet member further comprising third and fourth fold lines extending from a third and a fourth corner, respectively, of the four corners to the central region of the sheet member, the third corner being opposite from the first corner, the fourth corner being adjacent the first corner, the first, second, third and fourth fold lines delineating four triangular-shaped panel regions of the sheet member.

3. An outdoor shelter according to claim 2, the sheet member further comprising means for securing a guy-line to at least one of the panel regions of the sheet member.

4. An outdoor shelter according to claim 1, the sheet member further comprising:

a second slit extending from the central region of the sheet member toward but not to a third of the four corners, the second slit defining a second pair of opposing edges that extend from the central region toward but not to the third corner; and fourth and fifth complementary means disposed at the second pair of opposing edges for selectively and temporarily securing the second pair of opposing edges together, the second pair of opposing edges being part of a third fold line when secured together by the fourth and fifth complementary securing means.

5. An outdoor shelter according to claim 1, wherein the third securing means is secured to the second complementary securing means, the outdoor shelter is configured as a closed tent having a triangular-shaped base and a rainfly defined by a portion of the sheet member between the second fold line and the first complementary securing means, and the central region of the sheet member is raised by a cord attached to the rainfly.

6. An outdoor shelter according to claim 1, wherein the first and second complementary securing means are secured together, the outdoor shelter is configured as an open-ended shelter having a triangular-shaped base and an awning defined by two portions of the sheet member separated by the first fold line, and the central region of the sheet member is raised by a cord attached to the awning.

7. An outdoor shelter according to claim 1, wherein the outdoor shelter is configured as a reflector tent having a triangular-shaped base and a reflector defined by a portion of the sheet member between the second fold line and the first complementary securing means, and the central region of the sheet member is raised by a cord attached to the reflector.

8. An outdoor shelter according to claim 1, the sheet member further comprising sod cloths disposed at three of the four peripheral edges.

9. An outdoor shelter comprising a unitary sheet member having a square-shaped portion with oppositely-disposed interior and exterior surfaces and four peripheral edges that intersect to define four corners, the sheet member comprising:

a first slit extending from a first of the four corners to a central region of the sheet member, the first slit defining separated and parallel opposing edges between the first corner and the central region;

first and second complementary means disposed at the opposing edges defined by the first slit for selectively and temporarily securing the opposing edges together, the opposing edges defining a first fold line when secured together by the first and second complementary securing means;

a second fold line extending from a second of the four corners to the central region of the sheet member, the second corner being adjacent the first corner;

third securing means disposed on the interior surface of the sheet member along the second fold line so as not to be present on the exterior surface of the sheet member, the third securing means being complementary to the second complementary securing means to enable the second fold line to be temporarily secured to one of the opposing edges defined by the first slit;

third and fourth fold lines extending from a third and a fourth corner, respectively, of the four corners to the central region of the sheet member, the third corner being opposite from the first corner, the fourth corner being adjacent the first corner, the first, second, third and fourth fold lines delineating four triangular-shaped panel regions of the sheet member;

a second slit intersecting the first slit at the central region of the sheet member and extending from the central region toward but not to the fourth corner, the second slit defining a second pair of opposing edges that extend from the central region toward but not to the fourth corner; and fourth and fifth complementary means disposed at the second pair of opposing edges for selectively and temporarily securing the second pair of opposing edges together, the second pair of opposing edges being part of the fourth fold line when secured together by the fourth and fifth complementary securing means.

10. An outdoor shelter according to claim 9, the sheet member further comprising means for securing a guy-line to at least two of the panel regions of the sheet member.

11. An outdoor shelter according to claim 9, wherein the second complementary securing means is secured to the third securing means and not the first complementary securing means, the outdoor shelter is configured as a closed tent having a triangular-shaped base and a rainfly defined by one of the panel regions of the sheet member between the second fold line and the first complementary securing means which is disposed at an upper edge of the rainfly, and the central region of the sheet member is raised by a cord attached to the rainfly.

12. An outdoor shelter according to claim 11, wherein upper portions of the second complementary securing means and the third securing means are not secured together, and at least upper portions of the fourth and fifth complementary securing means are not secured together, thereby defining a ventilation opening near a peak of the closed tent.

13. An outdoor shelter according to claim 9, wherein the first and second complementary securing means are secured together, the outdoor shelter is configured as an open-ended shelter having a triangular-shaped base and an awning defined by two panel regions of the sheet member separated by the first fold line, and the central region of the sheet member is raised by a cord attached to the awning.

14. An outdoor shelter according to claim 9, wherein the outdoor shelter is configured as a reflector tent having a triangular-shaped base and a reflector defined by one of the panel regions of the sheet member between the second fold line and the first complementary securing means which is disposed at an upper edge of the reflector, the second complementary securing means is not secured to either of the third securing means and the first complementary securing means, and the central region of the sheet member is raised by a cord attached to the reflector.

15. An outdoor shelter according to claim 9, the sheet member further comprising sod cloths disposed at three of the four peripheral edges.

16. An outdoor shelter according to claim 1, wherein a slit is not present along the second fold line.

17. An outdoor shelter according to claim 9, wherein a slit is not present along either of the second and third fold lines.

18. An outdoor shelter comprising a sheet member having a rectangular-shaped portion that defines four corners and four peripheral edges, the sheet member comprising:

a first slit extending from a first of the four corners to a central region of the sheet member, the first slit defining separated opposing edges between the first corner and the central region;

first and second complementary means disposed at the opposing edges for selectively and temporarily securing the opposing edges together, the opposing edges defining a first fold line when secured together by the first and second complementary securing means; and third securing means disposed on a second fold line extending from a second of the four corners to the central region of the sheet member, the second corner being adjacent the first corner, the third securing means being complementary to the second complementary securing means to enable the second fold line to be temporarily secured to one of the opposing edges;

wherein the third securing means is secured to the second complementary securing means, the outdoor shelter is configured as a closed tent having a triangular-shaped base and a rainfly defined by a portion of the sheet member between the second fold line and the first complementary securing means, and the central region of the sheet member is raised by a cord attached to the rainfly.

19. An outdoor shelter comprising a sheet member having a rectangular-shaped portion that defines four corners and four peripheral edges, the sheet member comprising:

a first slit extending from a first of the four corners to a central region of the sheet member, the first slit defining separated opposing edges between the first corner and the central region;

first and second complementary means disposed at the opposing edges for selectively and temporarily securing the opposing edges together, the opposing edges defining a first fold line when secured together by the first and second complementary securing means; and third securing means disposed on a second fold line extending from a second of the four corners to the central region of the sheet member, the second corner being adjacent the first corner, the third securing means being complementary to the second complementary securing means to enable the second fold line to be temporarily secured to one of the opposing edges;

wherein the first and second complementary securing means are secured together, the outdoor shelter is configured as an open-ended shelter having a triangular-shaped base and an awning defined by two portions of the sheet member separated by the first fold line, and the central region of the sheet member is raised by a cord attached to the awning.

20. An outdoor shelter comprising a sheet member having a rectangular-shaped portion that defines four corners and four peripheral edges, the sheet member comprising:

a first slit extending from a first of the four corners to a central region of the sheet member, the first slit defining separated opposing edges between the first corner and the central region;

first and second complementary means disposed at the opposing edges for selectively and temporarily securing the opposing edges together, the opposing edges defining a first fold line when secured together by the first and second complementary securing means; and third securing means disposed on a second fold line extending from a second of the four corners to the central region of the sheet member, the second corner being adjacent the first corner, the third securing means being complementary to the second complementary securing means to enable the second fold line to be temporarily secured to one of the opposing edges;

wherein the outdoor shelter is configured as a reflector tent having a triangular-shaped base and a reflector defined by a portion of the sheet member between the second fold line and the first complementary securing means, and the central region of the sheet member is raised by a cord attached to the reflector.

* * * * *